US006480176B1

(12) United States Patent
Lardeau et al.

(10) Patent No.: US 6,480,176 B1
(45) Date of Patent: Nov. 12, 2002

(54) DRIVER CIRCUIT FOR DRIVING A PLASMA DISPLAY PANEL DRIVER MODULE INCORPORATING SAID CIRCUIT AND METHOD OF TESTING SUCH A MODULE

(75) Inventors: Céline Lardeau; Gilles Troussel, both of Grenoble; Eric Benoit, Eybens, all of (FR)

(73) Assignee: STMicroelectronics S.A., Gentilly (FR)

( * ) Notice: Subject to any disclaimer, the term of this patent is extended or adjusted under 35 U.S.C. 154(b) by 0 days.

(21) Appl. No.: 09/406,310

(22) Filed: Sep. 27, 1999

(30) Foreign Application Priority Data

Sep. 28, 1998 (FR) ..... 98 12100

(51) Int. Cl.[7] ..... G09G 3/28
(52) U.S. Cl. ..... 345/60; 345/69; 345/204
(58) Field of Search ..... 345/60, 66, 67, 345/204, 92, 69

(56) References Cited

U.S. PATENT DOCUMENTS 4,384,287 A * 5/1983 Sakuma ..... 340/771
5,805,123 A * 9/1998 Satoh et al. ..... 345/60
5,828,353 A * 10/1998 Kishi et al. ..... 345/55

FOREIGN PATENT DOCUMENTS

| | | |
|---|---|---|
| EP | 0 395 387 A1 | 10/1990 |
| EP | 0 680 067 A2 | 11/1995 |
| EP | 0 895 220 A1 | 2/1999 |
| FR | 2 487 099 | 1/1982 |
| WO | WO 98/33166 | 7/1998 |

OTHER PUBLICATIONS

Preliminary Search Report dated Jun. 15, 1999 with annex on French Application No. 98 12100.

* cited by examiner

*Primary Examiner*—Richard Hjerpe
*Assistant Examiner*—Kimnhung Nguyen
(74) *Attorney, Agent, or Firm*—Lisa K. Jorgenson; Stephen Bongini; Fleit, Kain, Gibbons, Gutman & Bongini P.L.

(57) ABSTRACT

A driver circuit for driving a plasma display panel comprising a plurality of cells arranged in a matrix of lines and columns; comprising a set of driver output stages connected to line or column electrodes to which a first electrode of cells of a same line or a same column are connected, respectively. The driver circuit includes a detection device for detecting a short circuit between two or more of the outputs of the driver output stages. It allows to test for alignment faults in the flexible cable connecting together the driver module housing incorporating the driver circuit and the electrodes of the plasma display panel.

20 Claims, 4 Drawing Sheets

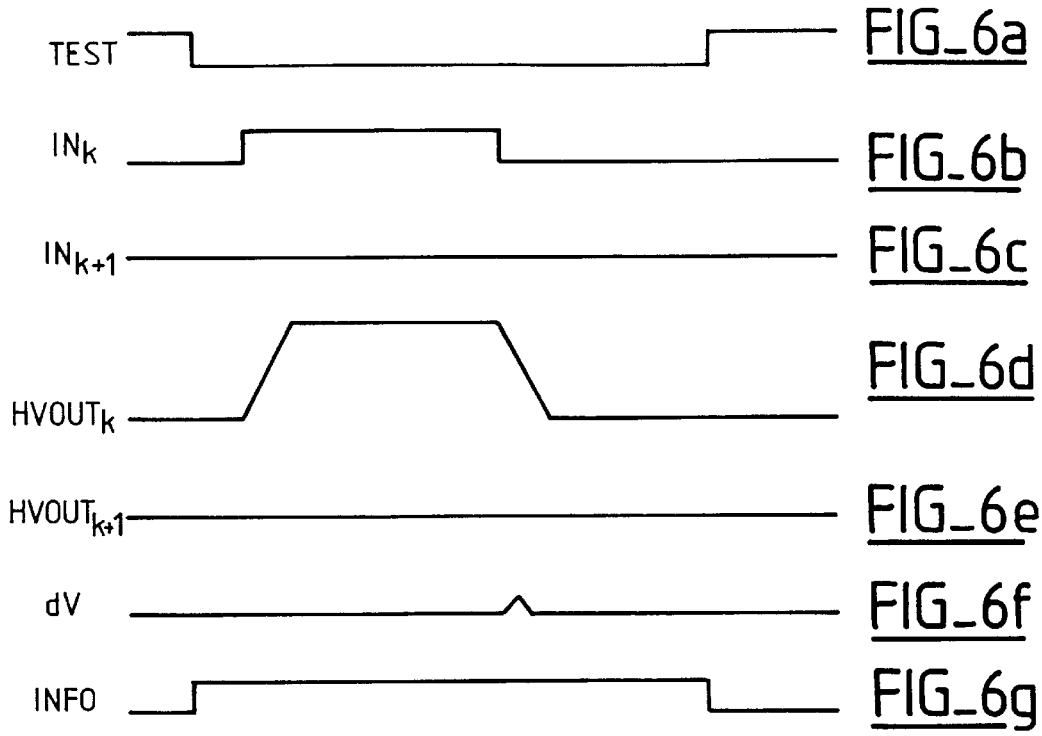
FIG_6a
FIG_6b
FIG_6c
FIG_6d
FIG_6e
FIG_6f
FIG_6g
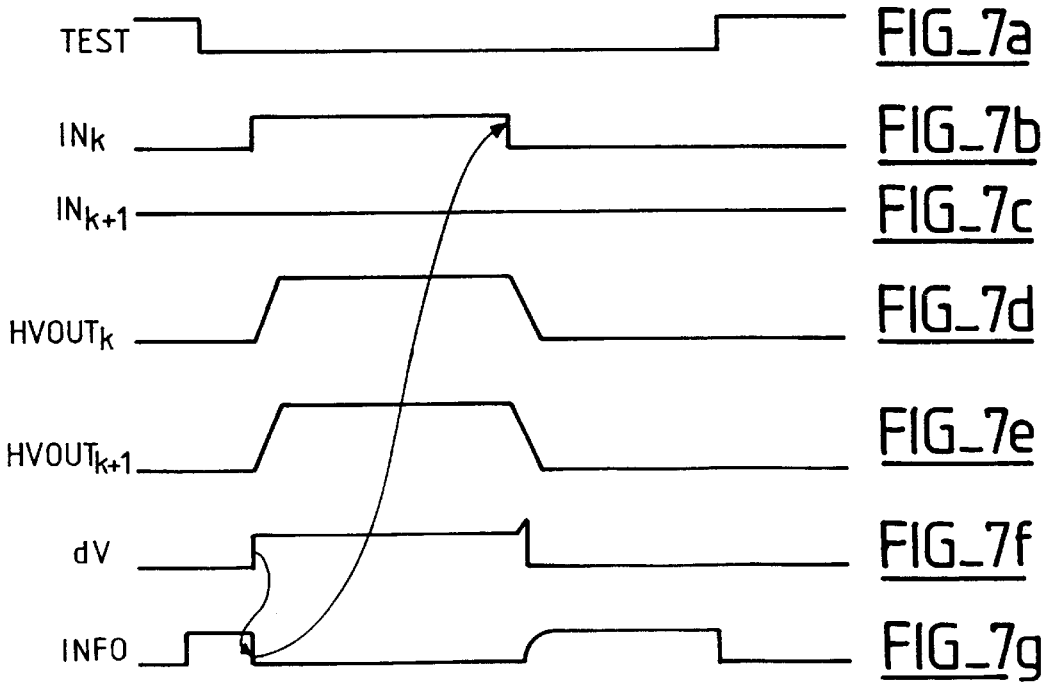
FIG_7a
FIG_7b
FIG_7c
FIG_7d
FIG_7e
FIG_7f
FIG_7g

DRIVER CIRCUIT FOR DRIVING A PLASMA DISPLAY PANEL DRIVER MODULE INCORPORATING SAID CIRCUIT AND METHOD OF TESTING SUCH A MODULE

CROSS-REFERENCE TO RELATED APPLICATIONS

This application is based on and claims the benefit of priority of the prior French Application 98/12100 filed Sept. 28, 1998.

BACKGROUND OF THE INVENTION

The present invention relates generally to a driver circuit for driving a plasma display panel, a driver module incorporating the latter and to a method of testing such a module. The invention finds application in the field of manufacturing and testing plasma display panels.

A plasma display panel is formed of cells arranged in a matrix of rows (hereafter referred to as lines) and columns. A cell comprises a cavity filled with a rare gas, two drive electrodes and deposit of red, green or blue phosphor. A given cell of the display is lit by applying a high voltage, on the order of a hundred volts, between its drive electrodes. The high voltage causes the gas in the cavity to ionise and emit ultraviolet light. The light excites the deposited phosphor, causing the latter to generate a luminous point of red, green or blue light respectively.

As shown in FIG. 1, each cell is connected at the intersection of a line and a column. More specifically, each cell Pij is connected by a first drive electrode to a conductor line Li common to all the cells of a same line bearing the sub-index i, where i is an integer between 1 and n inclusive, and by a second drive electrode to a conductor line Cj common to all the cells of a same column bearing the sub-index j, where j is an integer between 1 and m inclusive. Each of the conductor lines is connected to the outside through a line electrode or a column electrode respectively. To give an order of size, a 50 inch screen in a 16/9 format comprises around n=1000 line electrodes and m=3000 column electrodes. The line and column electrodes are sometimes referred to respectively as horizontal and vertical electrodes.

The driver circuits produce the high voltage drive signals required to set the cells of the panel in the lit or unlit state. A drive signal has a zero or negative potential, referred to as ground potential, when in the low logic state, and a potential (or voltage with respect to ground) of around 100 to 150 volts when in the high logic state. The logic states of such signals applied to the PDP line and column electrodes determine the cells that are driven to be lit and those that are driven to be unlit. These driver circuits receive low voltage command signals at their input. A command signal has a zero potential in the low logic state and a potential (or voltage with respect to ground) of 5 volts in the high logic state.

As seen from the driver outputs, the plasma display panel electrodes can be regarded as:

- a capacitor which must charged, or discharged, during an addressing sequence (i.e. when the high voltage drive signals change state); and
- a current source or sink whose current must be supplied or absorbed by the driver circuit, during a sustain sequence (to maintain the lit or unlit state of the cells).

The driver outputs are thus designed to supply or absorb a current on the order of several tens of milliamps.

In practice, the lines are addressed sequentially, i.e. line by line. To this end, the line electrodes are selected one after the other by applying to them appropriate high voltage signals. Drive signals, also of high voltage, are then applied simultaneously to the column electrodes by the driver outputs. The potential differences thus generated between the drive electrodes of the cells determine their lit or unlit state. Such a sequential addressing of the PDP electrode lines is possible by the virtue of the memory effect linked to the nature of the gas in the cell cavities.

FIG. 2 shows a plasma display panel 1 and the housing 3 of a driver module. The housing contains one (or several) printed circuit(s) on which the driver circuits, generally in integrated circuit form, are mounted. These are in the form of integrated circuits each containing e.g. up to 96 driver output stages and are able to access many electrodes of the PDP. The output of each driver output stage of the module drives a column electrode. To this end, the 96 outputs of the integrated circuits are connected to their column electrodes through adapted connecting means, generally via conductive tracks etched on the printed circuit.

The plasma display panel 1 comprises a glass plate 11 mounted on a substrate 12. The lower face of the plate 11 carries the phosphors (not shown). The line electrodes (generally designated by reference X) and the column electrodes (generally designated by reference Y) protrude from the glass plate 11 on the substrate 12. The electrical insulation between the different elements mentioned above is provided by layers of dielectric material (not shown). The inter-electrode pitch is very small and can reach 100 $\mu$m (microns).

The driver module comprises a housing 3, a low-voltage command signal input connector (not shown) and the aforementioned connecting means. The latter comprises a flat, flexible cable 5 having a set of parallel, mutually insulated conductive tracks at a pitch equal to that of the column electrodes, i.e. 100 $\mu$m. The flat cable 5 is more generally a flexible printed circuit on which tracks are etched (such a cable is sometimes referred to as a conductive track ribbon). It is stuck or pressed on the edge of the substrate 12, over the column electrodes Y.

Assembling the tracks of the flat cable 5 with the column electrodes Y is very critical. Indeed, two types of fault can generally appear after this assembling operation:

- a bad contact between one track of the flat cable and at least one column electrode, whereupon the cells of the corresponding column are not driven; and
- a misalignment between the tracks of the flat cable and the column electrodes, whereupon a track causes a short circuit between two adjacent column electrodes.

According to manufacturers, the proportion of faults arising from a short circuit between two column electrodes is 30%, against 70% of faults arising from non-connected electrodes, referred to as open-circuit electrodes. Now, the only possibility currently used for testing the assembling of the connecting means involves powering up the plasma display panel and causing it to display a predetermined image so as to check whether the image effectively displayed corresponds to the expected image, during final testing of the fully assembled panel. This technique is reliable but suffers from certain drawbacks.

Firstly, it can only be implemented after all the electronic circuits of the panel have been assembled, including those (not shown in FIG. 2) for generating the low voltage command signals. This means that if there occurs a misalignment of the connecting means between the driver module and the panel, it may be necessary to take the entire panel apart to correct the assembling fault.

Secondly, there is the possibility of a driver circuit being destroyed in the event of a short circuit between two column electrodes. This means that an assembling fault in the connecting means between the panel and the driver module can make it necessary to replace an integrated circuit of the driver module and even—as is generally the case—the printed circuit board which carries that integrated circuit. Accordingly, there is a need for a driver circuit that overcomes the above drawbacks of the prior art.

SUMMARY OF THE INVENTION

An object of the present invention is to overcome some or all of the drawbacks of the prior art mentioned above.

According to the invention, a driver circuit, for driving a plasma display panel formed of cells arranged in a matrix of lines and columns, comprises a set of driver stages whose outputs are connected to line or column electrodes to which are connected a first electrode of cells of a same line or a same column, respectively, and comprising means for detecting a short circuit between the outputs of at least some of the driver output stages.

Accordingly, the driver circuit according to the invention incorporates its own means for testing the proper assembly of the means connecting the driver module to the plasma display panel. Indeed, since the pitch between the conductive tracks of the connecting means is identical to the pitch between the column electrodes, any short circuit between two adjacent column electrodes via a track signifies that there is also a short circuit between two adjacent tracks via a column electrode, i.e. between the outputs of a driver circuit or of two different driver circuits of a same module.

Accordingly, it becomes possible to conduct a specific test for the assembly of the means connecting between the panel and the driver module. This test can be conducted before the panel is completely assembled.

To this end, the invention also contemplates a method of testing a driver module comprising one or a plurality of driver circuits as defined above, which comprises steps enabling the detection of a short circuit between the outputs of the driver circuits.

DESCRIPTION OF THE DRAWINGS

Other characteristics and advantages of the invention shall become apparent from reading the following description, given purely as an example, in conjunction with the appended drawings in which:

FIGS. 6*a* to 6*g* are timing diagrams of the signals delivered from or received by the driver circuit in the absence of a short circuit; and FIGS. 7*a* to 7*g* are timing diagrams of the signals delivered from or received by the driver circuit in the presence of a short circuit.

DETAILED DESCRIPTION OF A PREFERRED EMBODIMENT

Figure 3:
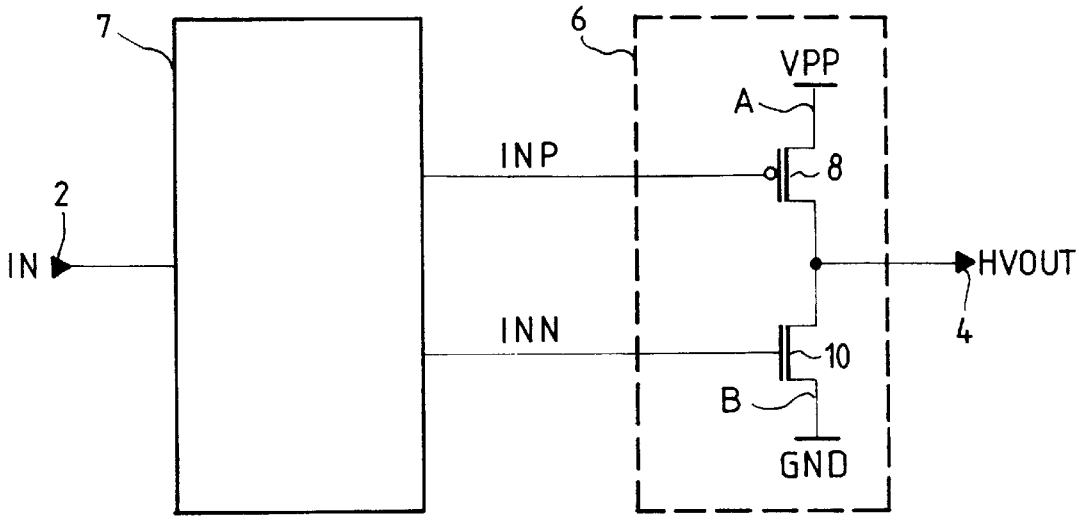
FIG. 3 is a diagram of a driver output stage of a driver circuit.

Referring to FIG. 3 there is shown a diagram of a driver output stage of a driver circuit. This stage comprises:

- an input 2 for receiving a command signal IN, which is a low-voltage logic signal;
- an output 4 for delivering a drive signal HVOUT, which is a high voltage signal;
- an output stage 6 comprising a charging transistor 8 and a discharging transistor 10, which shall be discussed in more detail below; and control means 7 for generating two command signals INP and INN sent respectively to the charging transistor and to the discharging transistor of the output stage to control these transistors as a function of low-voltage command signal IN.

The output 4 of a driver output stage such as shown in FIG. 3 is intended to be connected to a column electrode of the plasma display panel so that the drive signal HVOUT can set a cell to the lit or unlit state. As already explained, a cell can be considered, from a static point of view between its two drive electrodes, as an equivalent capacitor of relatively high value, on the order of ten picofarads (pF). This capacitor must be charged to light a cell and discharged to extinguish the cell.

In view of the high voltage to be attained for setting the cell to the lit state and the size of the capacitive load, the driver circuit must supply a charging current and absorb a discharging current of relative high value, which can reach several tens of milliamps.

It is the function of the output stage 6 to supply and absorb such currents. To this end, the charging transistor 8 and the discharging transistor 10 are power MOS transistors, respectively of P-type and N-type. For example, transistor 8 can be a VDMOS type transistor which can withstand high source-drain voltages and supply or absorb large currents. Transistor 10 can be a PMOS on oxide type transistor, which can withstand high source-drain and source-gate voltages. Transistor 10 can also be a compound MOS transistor, such as described in French patent application No. 97 06498 from the present applicant.

The source of the charging transistor 8 is connected to a node A which is connected to a high voltage power supply source VPP, on the order of a hundred volts, and its drain is connected to output 4. In addition, the drain of the discharging transistor 10 is connected to output 4 and its source is connected to a node B which is connected to ground GND. The control gates of transistors 8 and 10 respectively receive the aforementioned signals INP and INN.

As indicated, the charging transistor 8 is set to the conducting state (referred thereafter as switched ON) and the discharging transistor 10 is set to the non-conducting state (referred thereafter as switched OFF) for charging up the capacitive load so as to set the cell to the lit state, whereas the discharging transistor 10 is switched ON and the charging transistor 8 is switched OFF for discharging the capacitive load so as to set the cell to the unlit state.

The control means 7 further comprise means for preventing simultaneous conduction through the charging and discharging transistors during transitions, so as to avoid short-circuiting between the high voltage supply VPP and ground GND. The control means 7 are in themselves known and their description is not necessary for an understanding of the invention.

Accordingly, they shall not be described in detail in the present description.

There shall now be explained with reference to FIG. 4 what happens in the event of a short circuit between the outputs of two driver output stages connected to two adjacent column electrodes.

For the sake of simplicity, the figure shows only output circuits $\mathbf{6}_K$ and $\mathbf{6}_{K+1}$ of these two driver output stages (where k is a whole number for designating a specific output circuit amongst a series of such output circuits connected to the column electrodes). Each of the circuits $6_K$ and $6_{K+1}$ comprises a charging transistor, respectively $8_K$ and $8_{K+1}$, as well as a discharging transistor, respectively $10_K$ and $10_{K+1}$, connected as explained above with reference to FIG. 3.

In the event of a short circuit between the outputs $4_K$ and $4_{K+1}$ of circuits $6_K$ and $6_{K+1}$, the latter are connected together electrically through an impedance of essentially resistive nature, or a short circuiting resistance Rcc of very low value. As can be seen, the concept of a short circuit in accordance with the invention encompasses not only cases where the impedance between the outputs $4_K$ and $4_{K+1}$ is zero, but also cases where this impedance is very low.

In what follows, there shall be considered the case where the electrode connected to output $4_K$ is charged, and where the electrode connected to output $4_{K+1}$ is discharged.

In the case where charging transistor $8_K$ is ON (conducting) and discharging transistor $10_K$ is OFF (non-conducting), whilst charging transistor $8_{K+1}$ is OFF and discharging transistor $10_{K+1}$ is ON, the presence of the short circuiting resistor causes a short circuit current $I_{CC}$ to flow from node A to node B via charging transistor $8^K$, resistor Rcc and discharging transistor $10_{K+1}$ According to the invention, this short circuiting current is exploited to detect an alignment fault in the flat cable forming the connection means between the plasma panel and the driver module.

Figure 5:
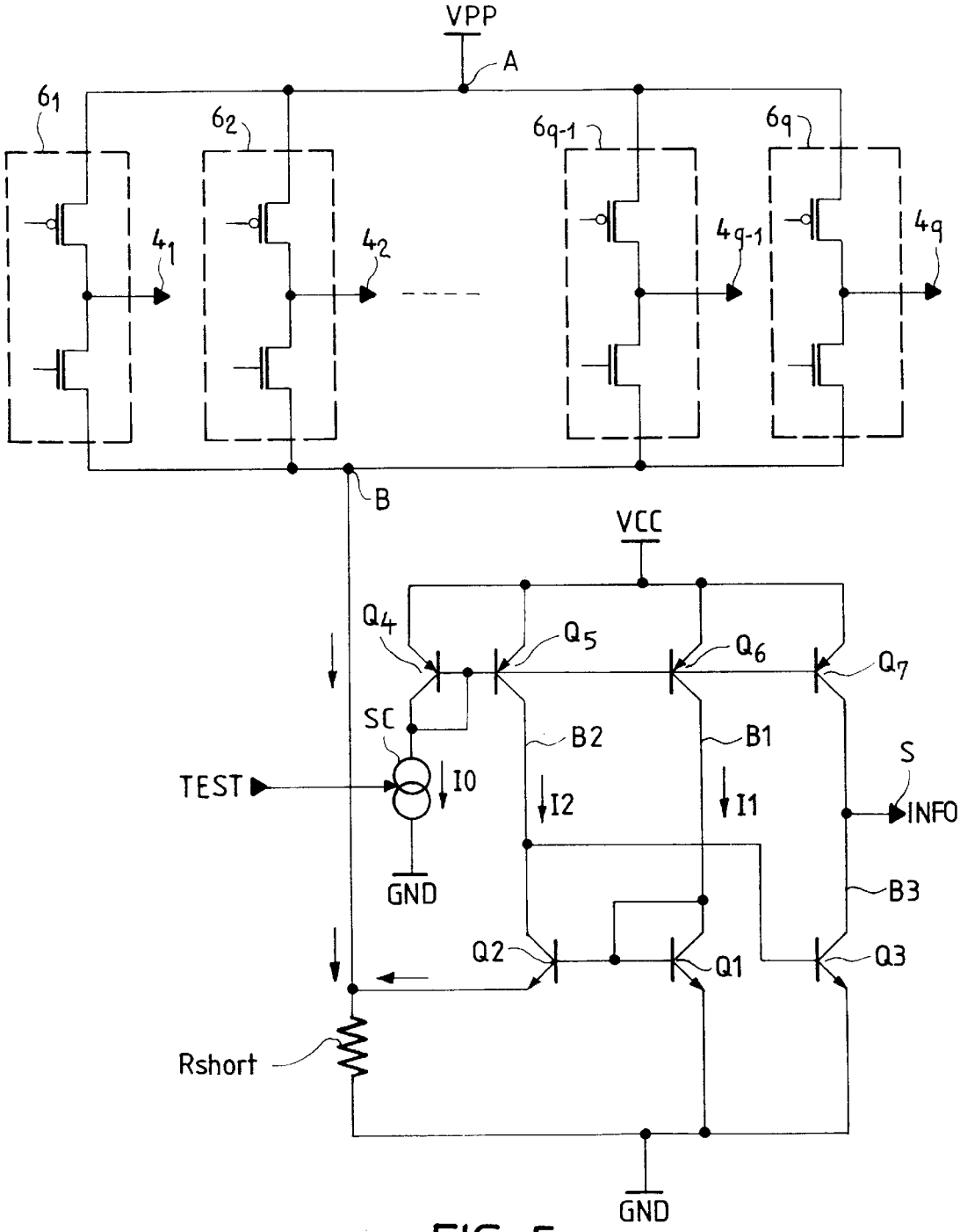
FIG. 5 is a simplified circuit diagram of a driver circuit according to the invention.

FIG. 5 shows a feasible embodiment for the driver circuit according to the invention.

The driver circuit comprises q driver output stages of the type shown in FIG. 3. Again for the sake of simplicity, the diagram has been simplified by showing in fact only the output circuits $6_1$, $6_2$, . . . , $6_{q-1}$, $6_q$ among the q driver circuits. Typically, q is equal to 64 or 96. The nodes A of each output stage are common, as shown in FIGS. 3 and 4. In other words, the q sources of the charging transistors of the driver circuit are connected together at a common node A. In FIG. 5, the common node A is connected to the voltage source that delivers the high supply voltage VPP.

Figure 4:
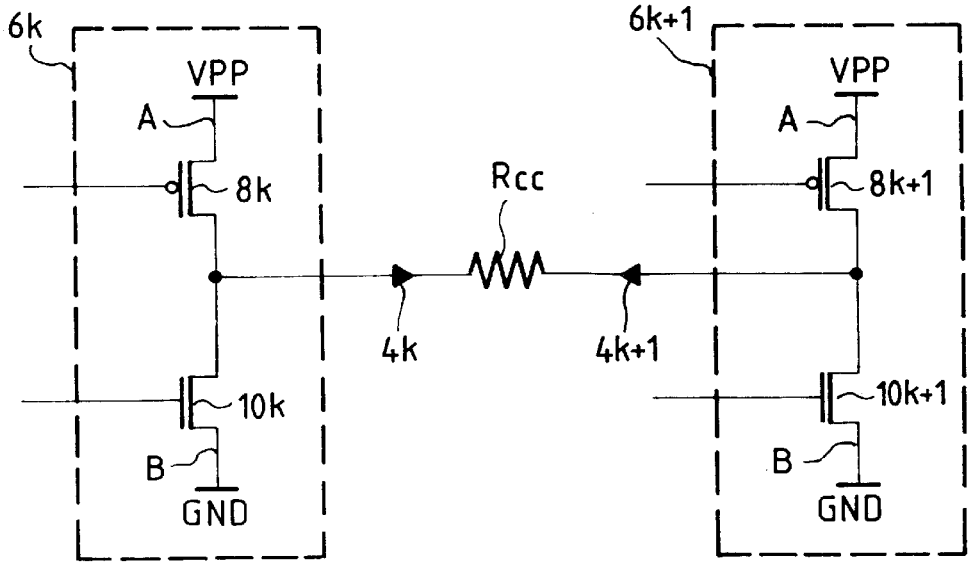
FIG. 4 is a diagram showing the short circuit impedance between the outputs of two driver output stages.

Likewise, the nodes B of each driver output stage are common, as shown in FIGS. 3 and 4, i.e. the sources of the discharging transistors of the output circuit of the q driver stages are connected together at a common node B, as shown in FIG. 5.

According to the invention, the common node B is connected to ground GND via a shunt resistor Rshort having a predetermined value. The driver circuit according to the invention further comprises means for comparing the voltage drop across the terminals of the shunt resistor Rshort with a predetermined threshold. These means are well known in themselves. They deliver a low voltage, short circuit detection signal.

The means for comparing the voltage drop at the terminals of the resistor Rshort with a threshold comprise four PNP bipolar transistors Q4, Q5, Q6 and Q7 in a current mirror configuration. To this end, transistor Q4 is diode connected, i.e. its base is connected to its collector, the latter being connected to ground GND via a current source SC. In addition, the bases of the four transistors Q4 to Q7 are connected together. Their emitters are also connected together to a power supply which produces a low power supply voltage VCC. Means may also be provided to deactivate the current source SC when the circuit is used outside the test mode, in order to limit the current consumption and energy losses due to the Joule effect.

A branch B1 connects the collector of transistor Q6 to the collector of an NPN bipolar transistor Q1, whose emitter is connected to ground. The base of transistor Q1 is moreover connected to its collector to make that transistor diode connected. A branch B2 connects the collector of transistor Q5 to the collector of an NPN bipolar transistor Q2, whose emitter is connected to the common node B.

Finally, a branch B3 connects the collector of transistor Q7 to the collector of an NPN bipolar transistor Q3, whose emitter is connected to ground. The base of transistor Q3 is also connected to the collector of transistor Q2.

Transistors Q1 and Q2 operate as a current mirror, whereupon the currents I1 and I2 flowing along the respective branches B1 and B2 are equal. An output S is taken from the collector of transistor Q3 and delivers a signal INFO which constitutes the short circuit detection signal. The latter is a low voltage logic signal.

The current source SC is moreover controlled by a logic signal TEST which is active at the low logic state.

There shall now be described the operation of the driver circuit shown in FIG. 5 during a test. This test is carried out once the panel 1, the flat cable 5 and the driver module housing 3 have been assembled. To this end, the flat cable 5 forming the connection means between the panel and the housing 3 is fitted so that the outputs of the module's driver circuits are connected to the column electrodes Y of the panel 1.

A method of testing the driver module comprises steps for checking the correct assembly of the flat cable forming the connection means between the driver module housing and the plasma display panel. These steps are:

a) switching to the ON state the charging transistor $8_K$ of the output circuit of a single driver output stage, which has for effect to set the corresponding output of the driver module to the voltage of the high voltage power supply VPP, all the other outputs of the driver module being connected to ground, b) while the charging transistor is in ON state, comparing the value of the voltage drop across the terminals of the shunt resistor Rshort with a predetermined threshold, c) in the event of the threshold being exceeded, generating a short circuit detection signal or, more precisely, delivering the signal INFO at the low logic state, d) repeating steps a) to c) above for each driver output stage of the driver circuit and for each driver circuit of the driver module. There shall now be described how the above method steps are implemented, and how a driver circuit operates during this implementation. To this end, there shall be considered what goes on for a driver output stage of index k and for another of index k+1, whose driver outputs are respectively connected to two adjacent column electrodes of the plasma display panel. In what follows, reference numerals containing a given index refer to elements or signals specific to the driver output stage designated by that index. Two cases shall be distinguished, according to whether the outputs 4k and 4k+1 of the driver output stages are, or are not, in a short circuit condition. The first case shall be described with reference to the timing diagrams of FIGS. 6*a* to 6*g*, and the second case with reference to the timing diagrams of FIGS. 7*a* to 7*g*. In addition, it is presumed that the output 4k−1 of the stage having index k−1 and the output 4k of the stage having index k are not in a short circuit condition.

In both cases, the driver module test method requires the activation of the current source SC (FIG. 5). This is obtained by applying a command signal TEST at the low logic state to a control input of the current source SC. Signal TEST is a logic signal which is active at the a low state. In other words, current source SC delivers a current 10 when signal TEST is at the low logic state. Accordingly, in FIGS. 6*a* and 7*a*, the portion of time during which the signal TEST is at the low logic state is a time a window during which the above-mentioned method steps a) to d) are performed. The driver module shall then be said to operate in the test mode.

For the implementation of step a), the stage having index k receives a low voltage command signal $IN_K$, shown in both FIG. 6*b* and FIG. 7*b*. This signal passes to the high logic state to command the charging of the column electrode to which the stage is connected. The other driver output stages, in particular the one bearing reference k+1 and likewise the one bearing a reference k−1, receive low voltage command signals like signal $IN_{K+1}$ shown in FIG. 6*c* and FIG. 7*c*. These signals are at the low logic state to command the discharging of the other column electrodes.

The output stages $\mathbf{4}_{K-1}$, $\mathbf{4}_K$ and $\mathbf{4}_{K+1}$ of the driver output stages bearing the indices k−1, k and k+1 respectively deliver high voltage drive signals $HVOUT_{K-1}$, $HVOUT_K$ and $HVOUT_{K+1}$. At this point, it is appropriate to distinguish between the two above-mentioned cases. In the first case (the outputs of $\mathbf{4}_K$ and $\mathbf{4}_{K+1}$ are not in a short circuit condition), signal $HVOUT_K$ is at the high logic state, i.e. it is at level VPP since the charging transistor $\mathbf{8}_K$ is ON and the discharging transistor $\mathbf{10}_K$ is OFF. Likewise, signal $HVOUT_{K+1}$ shown in FIG. 6*e*(like signal $HVOUT_{K-1}$, not shown) is at the low state since the discharging transistor $\mathbf{10}_{K+1}$(respectively $\mathbf{10}_{K-1}$) is ON and the charging transistor $\mathbf{8}_{K+1}$(respectively $\mathbf{8}_{K-1}$) is OFF. Note that, as shown in FIG. 6*d* in which it is represented, signal $HVOUT_K$ has a rising edge whose slope results from the capacitive nature of the load connected to the output $\mathbf{4}_K$.

Apart from a possible and transient discharge current from a previously charged electrode (in particular the one connected to output $\mathbf{4}_{K-1}$ of the stage bearing the index k−1), the current flowing from the common node B to ground GND through the shunt resistor Rshort is zero. Consequently, the only current flowing through this resistor is the current 12 delivered to ground by transistor Q2. This current, just like the current I1 delivered to ground by transistor Q1, is constant and equal to the current 10 delivered by the current source SC.

Consequently, the voltage drop across the terminals of resistor Rshort is constant. The variation of this voltage drop with respect to its normal value Rshort×IO, denoted dV and represented by the waveform of FIG. 6*f*, is thus zero.

The value of 10 is a such that Q2 is close to saturation whereupon, taking also into account the low value of Rshort, the voltage at the collector of the Q2 is lower than the conduction level for the base-emitter voltage of Q3. The term conduction level means the base-emitter voltage Vbe above which the transistor is conducting (ON). Transistor Q3 is thus OFF. Signal INFO is then at the high logic state, as shown by the signal line of FIG. 6*g*(it has the level of the low voltage power supply VCC, equal to 5 volts).

When the signal $IN_K$ returns to the low logic state, signal $HVOUT_K$ also falls again to the zero value, with a slope reflecting the capacitive discharge of the cell linked to the column electrode to which is connected the output $\mathbf{4}_K$ of the stage bearing index k. Indeed, transistor $\mathbf{8}_K$ switches OFF and transistor $lO_K$ switches ON.

In the second case (outputs $\mathbf{4}_K$ and $\mathbf{4}_{K+1}$ are in a short circuit condition), transistors $\mathbf{10}_{K-1}$, $\mathbf{8}_K$ and $\mathbf{10}_{K+1}$ are always in the ON state and transistors $\mathbf{8}_{K-1}$, $\mathbf{10}_K$ and $\mathbf{8}_{K+1}$ are always in the OFF state. Nevertheless, because of the presence of a short-circuiting resistor Rcc between the outputs $\mathbf{4}_K$ and $\mathbf{4}_{K+1}$, a short-circuiting current Icc flows from the common node receiving the high power supply voltage VPP up to common node B. This current then flows to ground GND through resistor Rshort. In addition, signals $HVOUT_K$ and $HVOUT_{K+1}$, shown respectively in FIGS. 7*d* and 7*e*, are identical (to within the voltage drop Rcc×Icc) and settle at an intermediate value between the level of VPP and the normal voltage level at the common node B (the level in the absence of a short circuit, i.e. Rshort×IO).

The current flowing through resistor Rshort is the sum of the current 12 delivered to ground by transistor Q2 (I1=12=IO) and the short circuiting current Icc. Accordingly, the voltage drop across resistor Rshort is increased by a value equal to Rshort×$I_{cc}$. This variation dV in the voltage drop across the terminals of resistor Rshort relative to its normal value Rshort×IO is thus non-zero and positive. It is depicted by the signal line of FIG. 7*f*.

This positive variation dV in the voltage drop across the terminals of Rshort is reflected by a drop in the base-emitter voltage of Q2, since Q1 and Q2 are connected as a current mirror. Because the current 12 from transistor Q5 remains unchanged and the collector current of transistor Q2 decreases owing to the variation in the base-emitter voltage, a base current flows in Q3.

The elements of the circuit shown in FIG. 5, in particular resistor Rshort, are scaled such that this base current causes Q3 to be conducting, i.e. such that the voltage between the collector of Q2 and ground GND becomes greater than the conduction level for the base-emitter voltage Vbe of Q3. The scaling of these elements is within the reach of the skilled person. The output S of the driver circuit shown in FIG. 5 is then pulled to ground via Q3, which operates in saturation. Consequently, signal INFO passes to the low logic state, as can be seen in FIG. 7*g* (it is equal to 0 volts).

Accordingly, the comparison referred to in step b) of the driver module testing method is implemented by transistor Q3 operating as a comparator. The threshold in question is the conduction level for the base-emitter voltage Vbe of Q3, from which must be subtracted the value of the collector-emitter voltage Vce of Q2. If the voltage drop across the terminals of Rshort is lower than this threshold, then Q3 is OFF and signal INFO is at the low logic state. Conversely, if the voltage drop exceeds this threshold, then Q3 is ON and signal INFO is at the high logic state.

As shall have been understood, the generation of a short circuit detection signal referred to in step c) of the driver module test method is constituted, in the described embodiment, by the transition of signal INFO to the low logic state. This logic signal must therefore be considered active in the low logic state. Naturally, it is a low voltage signal.

Figure 1:
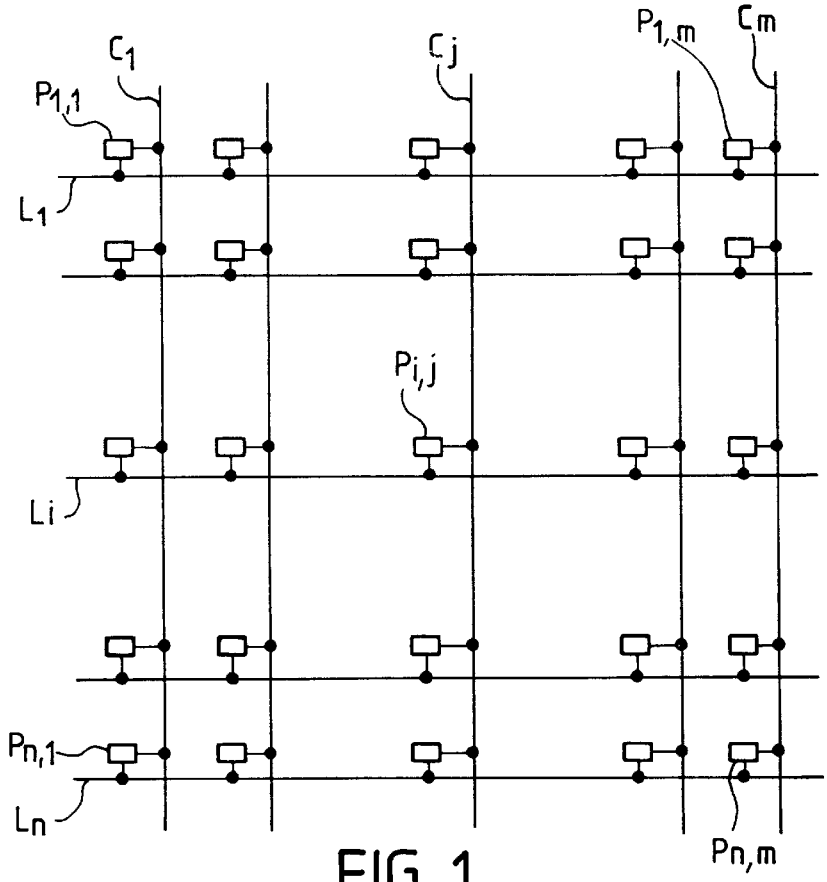
FIG. 1 shows a matrix of cells of a plasma display panel.
Figure 2:
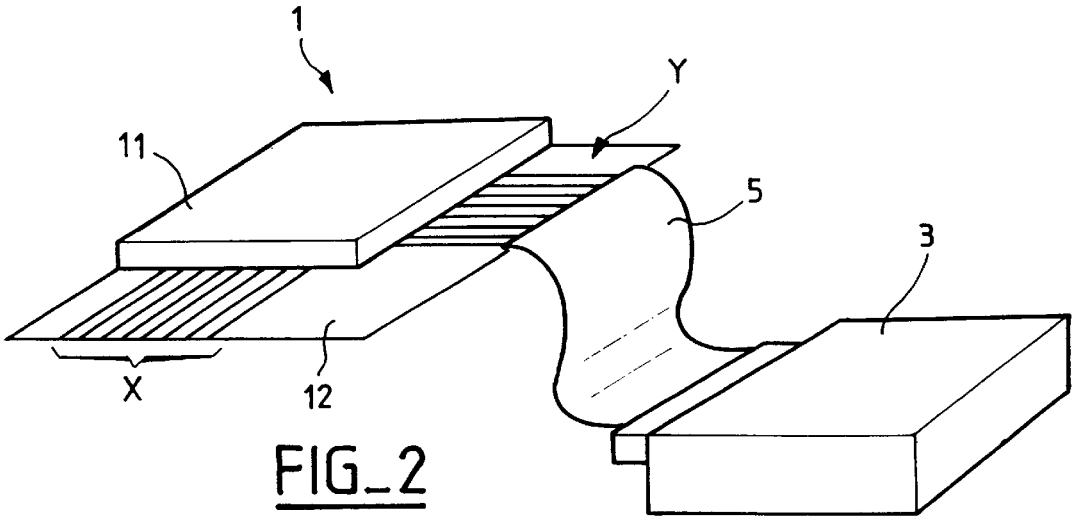
FIG. 2 shows a plasma display panel connected to a driver module.

Steps a) to c) are repeated for each driver output stage of the driver circuit and for each driver circuit of the driver module. This means that the steps whose implementation has been described above for a driver output stage of index k are repeated for each value of k between 1 and m−1. It is recalled that m is a whole number designating the number of column electrodes (FIG. 1) and, following this, the number of driver output stages that constitute the driver circuits of the driver module.

Preferably, in step c) signal INFO controls the switching OFF of charging transistor $\mathbf{8}_K$ of the stage bearing index k. In other words, the transition to the low logic state of signal INFO causes the transition to the low logic state of the command signal $IN_K$. This logical implication is symbolised by an arrow between the timing diagrams of FIGS. 7*g* and 7*b*. In this way, there is a reduced risk of destroying the MOS transistors which are conducting in the output circuits of the two driver output stages whose outputs are short-circuited.

To this end, a test equipment (not shown) receives signal INFO at an input and delivers at its outputs the command signals $IN_K$ that are sent as inputs to the driver module, as a function of a test programme and of the logic state of signal INFO. This equipment also delivers the above-mentioned signal TEST which is at the low logic state throughout the duration of the test. When the test is completely finished, signal TEST returns to the high logic state (FIGS. 6*a* and 7*a*) which has for effect, clearly, to bring back signal INFO to the low logic state. The test mode being deactivated, signal INFO can no longer act on the command of control signals $IN_K$ of the output stages.

It should be noted that FIGS. 6*f* and 7*f* show a slight peak in the signal dV corresponding to the transition of command signal $IN_K$ to the low logic state. Indeed, at that moment, the discharging transistor $\mathbf{10}_K$ of the output circuit belonging to the driver output stage bearing index k is brought to the conducting state, the effect of which is to discharge the capacitive load (i.e. the cell) linked to the column electrode to which it is connected. As a result of this, the cell's discharge current is drained from the common node B to ground GND through resistor Rshort, in the same manner as for a short circuiting current. It is perfectly clear, however, firstly that this phenomenon is transient and secondly that the comparator is designed so as not to switch on transient phenomena.

According to an advantageous characteristic of the invention, the value of VPP in the test mode is lower than the level required to set a cell to the lit state. For example, this value will be on the order of a few tens of volts, typically 30 volts, whereas it must be on the order of 100 volts to bring a cell to the lit state. In this way, the current consumption during the TEST process is limited. More importantly however, this limits the thermal dissipation due to the short circuiting currents Icc when two outputs are in a short circuit condition, and thus limits the risk of destroying the MOS transistors.

According to another advantageous characteristic of the invention, the shunt resistor Rshort has a low value so as not to increase prohibitively the ON resistance of the driver output stage's discharging transistor, i.e. the drain-source resistance of that transistor when it is in the conducting state. Indeed, such an increase would slow down the discharge of the cell linked to the column electrode to which the output of that stage is connected, and increase the thermal dissipation. It is recalled that the value of Rshort must nevertheless be high enough for the voltage variation dV to be sufficient to make transistor Q3 conducting. This value is therefore the result of a compromise. In practice, Rshort is given a value which is at the most on the order of the ON resistance of the charging and discharging transistors.

According to an advantageous characteristic of the invention, the shunt resistor is preferably connected between the common node B and ground GND. This situation is advantageous from two standpoints.

The connection of a shunt resistor between the output $\mathbf{4}_K$ of each driver output stage bearing index k and ground GND to which this output is normally connected (see FIGS. 3 and 4) would have required m such shunt resistors (one per driver output stage) and as many groups of means for comparing the voltage drop at its terminals with a threshold.

It is therefore an advantageous measure to connect the sources of all the discharging transistors $\mathbf{10}_K$, for k varying from 1 to m, to a single common node B connected to ground GND by the shunt resistor, as shown in FIG. 5. This arrangement requires only one shunt resistor and one single group of means for comparing the voltage drop across its terminals with a threshold. From this viewpoint, it would have been just as possible to connect the drains of all the charging transistors $\mathbf{8}_K$, for k varying from 1 to m, to a common node A connected to the high voltage power supply source VPP via the shunt resistor. However, the connection of the shunt resistor between the common node B and ground GND offers an additional advantage. Specifically, the voltage drop across the terminals of the shunt resistor is then referenced with respect to ground. The means for comparing the voltage drop across the terminals of the shunt resistor with a threshold are thus easier to implement and dissipate less static power since they operate at lower voltages (typically the 5 volt low power supply voltage VCC instead of the high power supply voltage VPP of around 30 volts in the test mode).

In the above-described embodiment, the means for comparing the voltage drop across the shunt resistor with a threshold has been described in accordance with a classical embodiment, which is simple and effective. Nevertheless, other embodiments are feasible for these means.

Finally, in the above-described embodiment, the driver output stages of the driver module are connected to the column electrodes Y of the plasma display panel. Naturally, they can just as well be connected to the line electrodes of the panel, without having to modify the means of the invention. In other words, the terms line electrodes and column electrodes are interchangeable in the above disclosure.

What is claimed is:

1. A driver circuit for driving a plasma display panel formed of cells arranged in a matrix of lines and columns, said driver circuit comprising:

a set of driver output stages having outputs connected to line or column electrodes which are each connected to a first electrode of cells of a same line or a same column, respectively; and detection means for detecting a short circuit between two of the outputs of the driver output stages, wherein the detection means includes:

a shunt resistor connected between a first node common to all of the driver output stages and one of a high voltage power supply source and ground; and comparison means for comparing the voltage drop across the terminals of the shunt resistor with a predetermined threshold, the comparison means delivering a short circuit detection signal based on the result of the comparison, and the value of the shunt resistor is low so as not to increase prohibitively the resistance of the driver output stages.

2. The driver circuit according to claim 1, wherein each driver output stage comprises:

a charging transistor whose source is connected to the first node and whose drain is connected to the output; and a discharging transistor whose source is connected to a second node common to all of the driver output stages and whose drain is connected to the output.

3. The driver circuit according to claim 1, wherein the shunt resistor is connected between the first node and ground.

4. The driver circuit according to claim 2, wherein the value of the shunt resistor is at highest on the order of the ON resistance of the charging and discharging transistors.

5. A method of testing a driver module for driving a plasma display panel, the driver module comprising a shunt resistor and a set of driver output stages each having a charging transistor and a discharging transistor, said method comprising the following steps:

(a) switching to the ON state the charging transistor of a single driver output stage;

(b) while the charging transistor of the single driver output stage is in the ON state, comparing the value of the voltage drop across the terminals of the shunt resistor with a predetermined threshold; and (c) in the event of the threshold being exceeded by said voltage drop, generating a short circuit detection signal that indicates a short circuit has been detected.

6. The method according to claim 5, wherein in step (c), the short circuit detection signal commands the switching to the OFF state of the charging transistor of the single driver output stage.

7. The method according to claim 5 wherein in a test mode for testing the driver module, the voltage of the high voltage power supply is lower than the voltage required for setting a cell of the plasma display panel to the lit state.

8. A plasma display panel comprising:

a plurality of cells arranged in a matrix of lines and columns; and a driver circuit comprising:

a set of driver output stages having outputs connected to line or column electrodes which are each connected to a first electrode of the cells of a same line or a same column, respectively; and detection means for detecting a short circuit between two of the outputs of the driver output stages, wherein the detection means includes:

a shunt resistor connected between a first node common to all of the driver output stages and one of a high voltage power supply source and ground; and comparison means for comparing the voltage drop across the terminals of the shunt resistor with a predetermined threshold, the comparison means delivering a short circuit detection signal based on the result of the comparison, and the value of the shunt resistor is low so as not to increase prohibitively the resistance of the driver output stages.

9. The plasma display panel according to claim 8, wherein each driver output stage comprises:

a charging transistor whose source is connected to the first node and whose drain is connected to the output; and a discharging transistor whose source is connected to a second node common to all of the driver output stages and whose drain is connected to the output.

10. The plasma display panel according to claim 8, wherein the shunt resistor is connected between the first node and ground.

11. The plasma display panel according to claim 9, wherein the value of the shunt resistor is at highest on the order of the ON resistance of the charging and discharging transistors.

12. The driver circuit according to claim 1, wherein each driver output stage comprises:

a charging transistor whose source is connected to a second node common to all of the driver output stages and whose drain is connected to the output; and a discharging transistor whose source is connected to the first node and whose drain is connected to the output.

13. The driver circuit according to claim 1, wherein the shunt resistor is connected between the first node and the high voltage power supply source.

14. The driver circuit according to claim 2, wherein the value of the shunt resistor is at highest on the order of the ON resistance of the charging transistor.

15. The driver circuit according to claim 12, wherein the value of the shunt resistor is at highest on the order of the ON resistance of the discharging transistor.

16. The method according to claim 5, further comprising the step of repeating steps (a) to (c) for each of the driver output stages of the driver module.

17. The plasma display panel according to claim 8, wherein each driver output stage comprises:

a charging transistor whose source is connected to a second node common to all of the driver output stages and whose drain is connected to the output; and a discharging transistor whose source is connected to the first node and whose drain is connected to the output.

18. The plasma display panel according to claim 8, wherein the shunt resistor is connected between the first node and the high voltage power supply source.

19. The plasma display panel according to claim 9, wherein the value of the shunt resistor is at highest on the order of the ON resistance of the charging transistor.

20. The plasma display panel according to claim 17, wherein the value of the shunt resistor is at highest on the order of the ON resistance of the discharging transistor.

* * * * *